US012702178B2

(12) United States Patent
Kim

(10) Patent No.: US 12,702,178 B2
(45) Date of Patent: Aug. 11, 2026

(54) CAP AND MANUFACTURING METHOD THEREOF

(71) Applicant: YUPOONG, INC., Seoul (KR)

(72) Inventor: Jung Hwan Kim, Anyang-si (KR)

(73) Assignee: YUPOONG, INC., Seoul (KR)

( * ) Notice: Subject to any disclaimer, the term of this patent is extended or adjusted under 35 U.S.C. 154(b) by 0 days.

(21) Appl. No.: 18/130,486

(22) Filed: Apr. 4, 2023

(65) Prior Publication Data

US 2024/0041148 A1 Feb. 8, 2024

(30) Foreign Application Priority Data

Aug. 4, 2022 (KR) ..... 10-2022-0097409

(51) Int. Cl.
*A42B 1/019* (2021.01)
*A42B 1/02* (2006.01)

(52) U.S. Cl.
CPC ..... *A42B 1/019* (2021.01); *A42B 1/02* (2013.01)

(58) Field of Classification Search
CPC ..... A42B 1/02; A42B 1/0182; A42B 1/019; A42B 1/208; D06H 5/003; D05B 17/00; D05B 1/26; D05B 23/002; A42C 1/00; A42C 5/02; A42C 99/00; D06M 23/18
USPC ..... 2/175.5
See application file for complete search history.

(56) References Cited

U.S. PATENT DOCUMENTS 5,231,745 A * 8/1993 Phelan ..... A47C 7/18 264/45.1
6,493,880 B1 * 12/2002 Lo ..... A42B 1/22 2/195.2
2005/0081281 A1 * 4/2005 Hannon ..... B29C 66/133 2/275
2006/0206982 A1 * 9/2006 Cho ..... A42B 1/22 2/195.8
2008/0264320 A1 * 10/2008 Harward ..... B29C 65/08 112/475.17
2008/0295223 A1 * 12/2008 Tai ..... A42B 1/04 2/195.3
2009/0199320 A1 8/2009 Ng
2011/0070796 A1 * 3/2011 Renzo ..... A41D 27/245 442/183
2012/0186720 A1 * 7/2012 Cartabbia ..... B29C 65/505 156/93
2012/0272432 A1 * 11/2012 Cho ..... A42B 1/002 2/181
2012/0282425 A1 * 11/2012 Gallagher ..... B29C 65/4815 428/351
2013/0153119 A1 * 6/2013 Hannon ..... B29C 66/43 156/308.4

(Continued)

FOREIGN PATENT DOCUMENTS

JP 2013-129940 7/2013
JP 2017-166086 A 9/2017

(Continued)

*Primary Examiner* — Matthew R Marchewka
(74) *Attorney, Agent, or Firm* — LEX IP MEISTER, PLLC

(57) ABSTRACT

A cap is formed of a crown portion formed by connecting a plurality of panels, a brim portion attached to a lower end of the crown portion, and a sweat absorbing portion attached to an inner lower end of the crown portion, and at least two adjacent panels among the plurality of panels are connected to each other by sewing and ultrasonic wave processing.

10 Claims, 17 Drawing Sheets

(56) References Cited

U.S. PATENT DOCUMENTS

| | | | | |
|---|---|---|---|---|
| 2013/0255103 | A1* | 10/2013 | Dua | A43B 23/0255 428/57 |
| 2018/0279712 | A1 | 10/2018 | Wang | |
| 2023/0220595 | A1* | 7/2023 | Bell | D06M 15/643 428/102 |

FOREIGN PATENT DOCUMENTS

| | | | |
|---|---|---|---|
| KR | 20-2008-0005938 | U | 12/2008 |
| KR | 10-2012-0122297 | A | 11/2012 |
| KR | 10-2017-0005677 | | 1/2017 |

* cited by examiner

- Prior Art -

- Prior Art -

- Prior Art -

- Prior Art -

- Prior Art -

- Prior Art -

- Prior Art -

CAP AND MANUFACTURING METHOD THEREOF

CROSS-REFERENCE TO RELATED APPLICATION

This application claims priority to and the benefit of Korean Patent Application No. 10-2022-0097409 filed in the Korean Intellectual Property Office on Aug. 4, 2022, the entire contents of which are incorporated herein by reference.

BACKGROUND OF THE INVENTION

The present invention relates to a cap and a cap manufacturing method. More particularly, the present invention relates to a cap including a crown manufactured by connecting a plurality of panels, and a brim, and a manufacturing method thereof.

(b) Description of the Related Art

In general, as shown in FIG. 1, a cap is formed of a hemispherical crown 10 worn on the head, a brim 20 attached to a lower front of the crown 10, and a sweat absorbing portion attached in the circumferential direction at the bottom of the crown 10.

In the cap, a plurality of panel pieces are connected to make a hemispherical shaped crown 10, and the existing manufacturing method for connecting panel pieces is divided into two types.

First, as shown in FIG. 2A to FIG. 2C, two panels 1 and 2 are connected by sewing at regular intervals to form seams 4-1 and 4-2. Open the seams 4-1 and 4-2 and cover the folded seams over with a tape 5. The tape 5, the seams 4-1 and 4-2 and the panels 1 and 2 are sewn up, all together, along both edges of the tape 5. The seam portion where the panels are connected in this manner forms a raised surface and increases thickness, which leads to discomfort when worn. In particular, the thicker the fabric being used, the more discomfort it causes.

In addition, most cap products are decorated with embroidery for brand display and aesthetic expression. When embroidery is carried out on the seam portion with increased thickness, the needle of the embroidery machine is often broken or the embroidery thread is cut off due to the resistance load of the embroidery thread and the needle, which causes lower productivity and deterioration of embroidery quality.

Secondly, there is a seamless seam-sealing method designed to reduce the thickness of the seam portion described above and to add waterproof function: As shown in FIG. 3A to FIG. 3C, two panels 1 and 2 go through ultrasonic wave processing 7 at regular intervals, and the ultrasonic wave-processed portions are unfolded to both sides and a seam sealing tape 8 coated with an adhesive 9 is heat-sealed thereupon. The cap made as described above has a connected seam portion that is thin and thus provides better wearing comfort, but the ultrasonic wave processing is effective only on synthetic fiber materials such as polyester and nylon—the processing does not work on natural fiber materials such as cotton, rayon, and wool, which are the more popular in headwear manufacturing. In addition, the width of the seam portion melt by the ultrasonic wave processing is very thin and thus of low durability; the seam portion is often damaged.

The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention is to solve the above problem, and according to the present invention, a cap and a manufacturing method of the cap can be provided where panels forming a crown are connected by both sewing and ultrasonic wave processing, and thereby the seam portion of the connected panels is thin while having improved durability. Furthermore, there is no material restriction—the method can be employed for natural fabrics as well as man-made fibers.

A cap according to an embodiment of the present invention is formed of a crown portion formed by connecting a plurality of panels, a brim portion attached to a lower end of the crown portion, and a sweat absorbing portion attached to an inner lower end of the crown portion, and at least two adjacent panels among the plurality of panels are connected to each other by sewing and ultrasonic wave processing.

The sewing and the ultrasonic wave processing may be simultaneously carried out to the adjacent panels being overlapped with each other.

The ultrasonic wave processing may be carried out at an end of the panel, and the sewing is carried out at a distance separated from the end of the panel.

The separated distance may be 0.5 mm to 1.5 mm.

The adjacent panels are unfolded after the sewing and the ultrasonic wave processing, and then a seam sealing tape may be attached to cover the processed portions.

An adhesive may be coated to one side of the seam sealing tape, and the seam sealing tape may be attached by the adhesive to the portions processed by the sewing and the ultrasonic wave processing.

The seam sealing tape may be attached by thermal adhesion to the portions processed by the sewing and the ultrasonic wave processing.

The seam sealing tape may have a thickness of 0.2 mm to 0.5 mm.

The seam sealing tape may have a width of 10 mm to 20 mm.

The seam sealing tape may be formed of a mixed material of synthetic fiber and thermoplastic resin.

The adhesive may be 20 μm to 200 μm in thickness.

The plurality of panels may be formed of either synthetic fiber or natural fiber or a combination thereof.

The plurality of panels may be formed of polyester or nylon.

The plurality of panels may be formed of either one of cotton, rayon, or wool, or a combination thereof.

Meanwhile, a method for manufacturing the cap includes: cutting the plurality of panels; connecting the plurality of panels by sewing and ultrasonic wave processing; attaching a seam sealing tape to cover the portions processed by the sewing and the ultrasonic wave processing; attaching the sweat absorbing portion and attaching a top button to a top center portion of the crown portion; and attaching the brim portion.

The method for manufacturing the cap according to the embodiment of the present invention may further include an embroidery process on the panel.

According to the embodiment of the present invention, the sewing and the ultrasonic wave processing may be simultaneously carried out to connect the panels that form the crown of the cap, thereby minimizing the thickness of the seam portion where the panels are connected and producing a smooth surface that improves wearing comfort.

In addition, the method improves productivity and quality associated with the embroidery process by reducing the occurrence of needle or thread breakage of the embroidery machine.

In addition, compared to the existing seamless sealing method, the method can improve durability since the sewing and the ultrasonic wave processing are performed simultaneously.

In addition, the method can be employed for natural fibers as well as synthetic fibers, and thus consumers can get a wide range of choice in style.

DETAILED DESCRIPTION OF THE EMBODIMENTS

Figure 1:
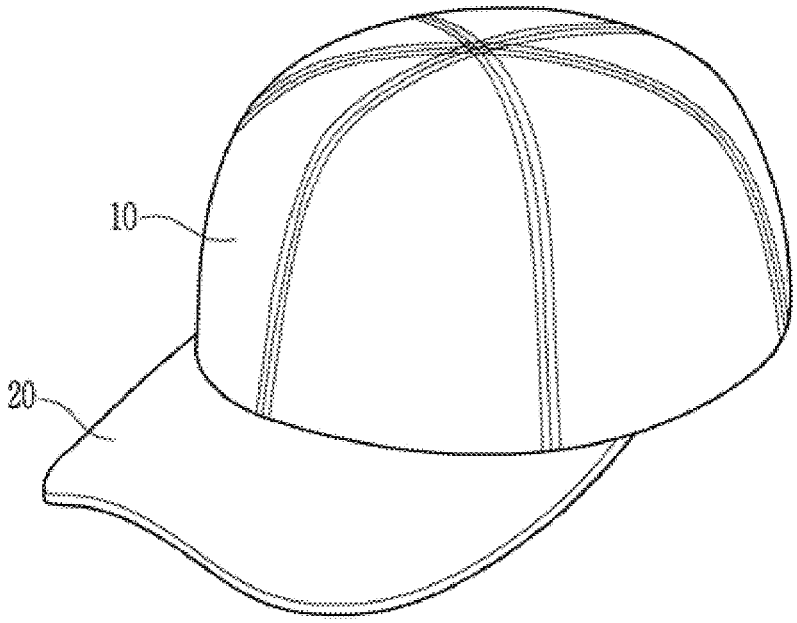
FIG. 1 shows an existing cap product.

Hereinafter, embodiments of the present invention will be described in detail with reference to the accompanying drawing so as to be easily implemented by a person of an ordinary skill in the technical field to which the present invention belongs. The present invention may be implemented in several different forms and is not limited to the embodiments described herein.

In addition, in various embodiments, the same reference numerals are used for representative elements having the same configuration in an embodiment, and in other embodiments, only configurations different from an embodiment will be described.

It should be noted that drawings are schematic and not drawn to scale. The relative dimensions and ratios of parts in the drawing are exaggerated or reduced in size for clarity and convenience in the drawing, and any dimensions are illustrative only and not limited thereto. In addition, the same reference sign is used to indicate similar features to the same structure, element or part appearing in the drawing of two or more. When a part is referred to as being "on" or "above" another part, it may be directly on top of the other part or may be accompanied by the other part in between.

An embodiment of the present invention specifically represents one of embodiments of the present invention. As a result, numerous variations of the illustration are expected. Therefore, an embodiment is not limited to a specific shape of the illustrated area, and includes, for example, a shape modification by manufacturing.

Hereinafter, a cap according to an embodiment will be described in detail with reference to the accompanying drawings.

Figure 5:
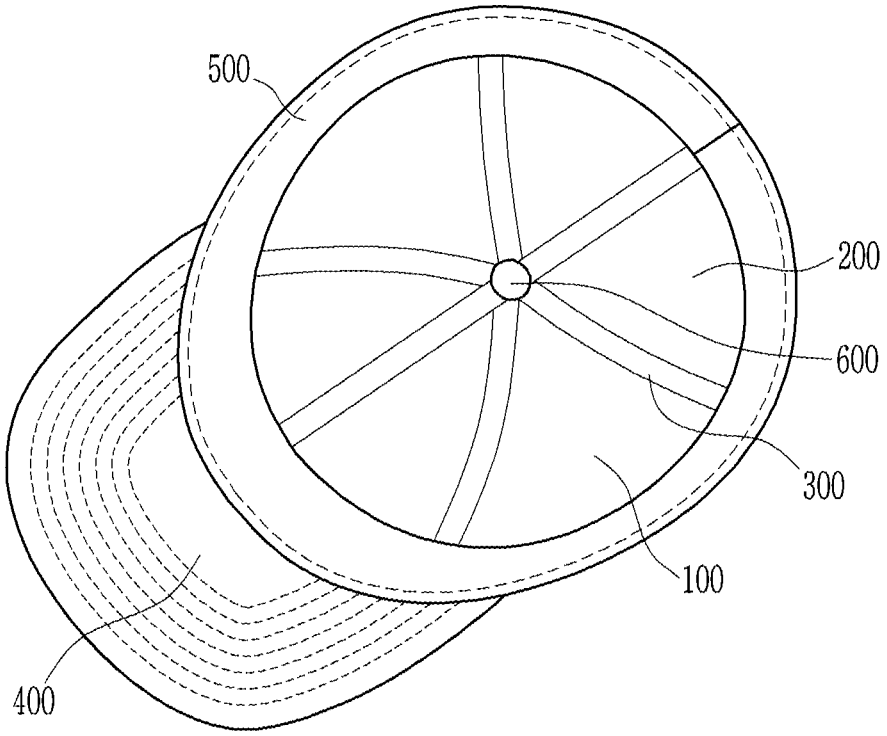
FIG. 5 is an internal perspective view of the cap according to the embodiment of the present invention.
Figure 6:
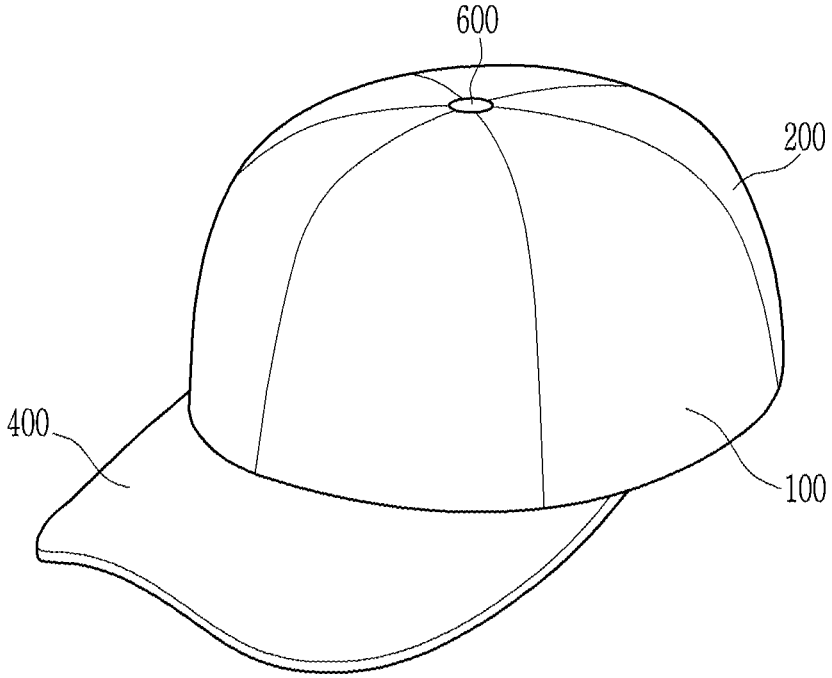
FIG. 6 is an external perspective view of the cap according to the embodiment of the present invention.

FIG. 4A to FIG. 4D show a process for manufacturing a crown of a cap according to an embodiment of the present invention. FIG. 5 is an internal perspective view of the cap according to the embodiment of the present invention, and FIG. 6 is an external perspective view of the cap according to the embodiment of the present invention.

A cap according to an embodiment of the present invention is formed of a crown portion manufactured by connecting a plurality of panels (formed by coupling a plurality of panels 100 and 200), a brim 400 attached to a lower end of the crown portion, and a sweat absorbing portion 500 attached to an inner lower end of the crown portion. The crown portion is a portion that covers a wearer's head and a dome-shaped structure—a plurality of panels 100 and 200 are connected with the lower part opened, and the upper part round. A top button 600 is attached to the top of the crown portion such that the shape of the crown portion can be fixed.

In addition, the brim portion 400 is attached to the lower portion of the crown portion and serves to cover sunlight. The brim portion 400 may be formed to protrude forward on the front of the lower portion of the crown portion, or may be formed on the entire circumference of the lower portion of the crown portion.

The plurality of panels 100 and 200 forming the crown portion of the cap according to the embodiment of the present invention may be connected to each other by performing sewing 110 and ultrasonic wave processing 120 simultaneously.

Figure 4A:
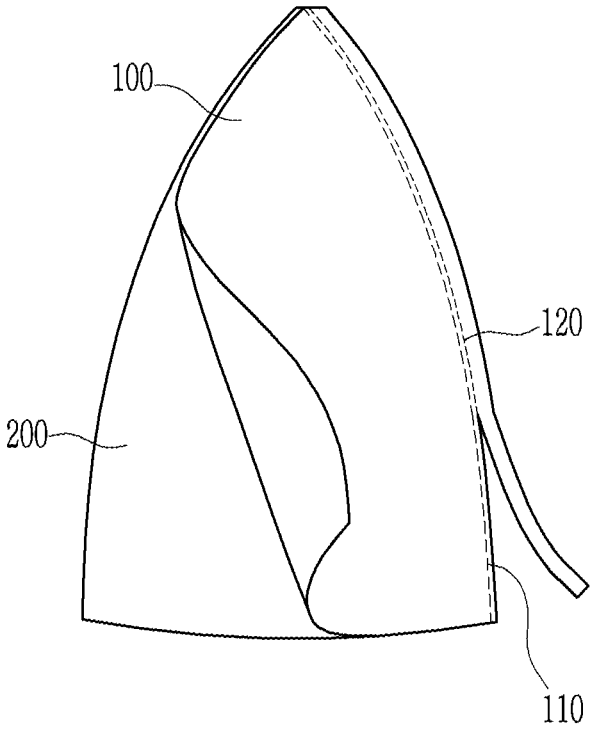
FIG. 4A to FIG. 4D show a process for manufacturing a crown of a cap, manufactured according to an embodiment of the present invention.

As shown in FIG. 4A, the plurality of panels 100 and 200 cut into a uniform shape for a crown shape are prepared and the adjacent panels 100 and 200 are disposed to overlap each other. Sewing 110 and ultrasonic wave processing 120 are simultaneously performed in order to join the adjacent panels 100 and 200 together. That is, along a lateral side of the panels 100 and 200, lengthways, sewing 110 with a thread and a needle and ultrasonic wave processing 120 are performed. The ultrasonic wave processing 120 is a method of cutting the panels 100 and 200 with physical force while melting the panels 100 and 200 with instantaneous high heat generated by ultrasonic wave. When the ultrasonic wave processing 120 is performed on the panels 100 and 200 made of synthetic fibers, bonding and cutting are performed simultaneously as the cut areas are melted. But, in the case of the panels 100 and 200 being natural fibers, only cutting is performed.

Figure 4B:
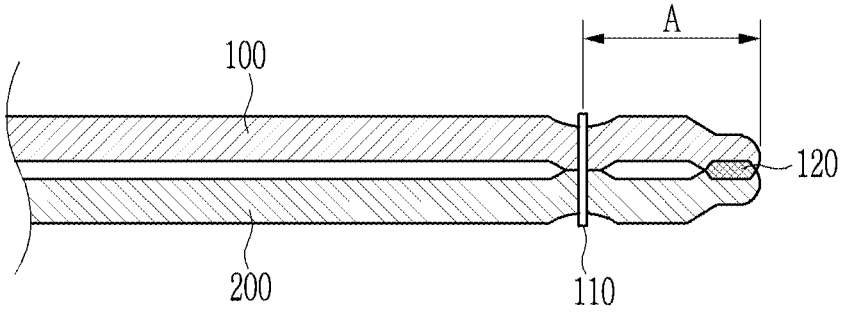

As shown in FIG. 4B, the ultrasonic wave processing 120 is performed at the ends of edges of the panels 100 and 200, and the sewing 110 is performed at a predetermined distance from the ends of edges of the panels 100 and 200. In this case, a spaced-apart distance A may be set to about 0.5 mm to about 1.5 mm.

Figure 4C:
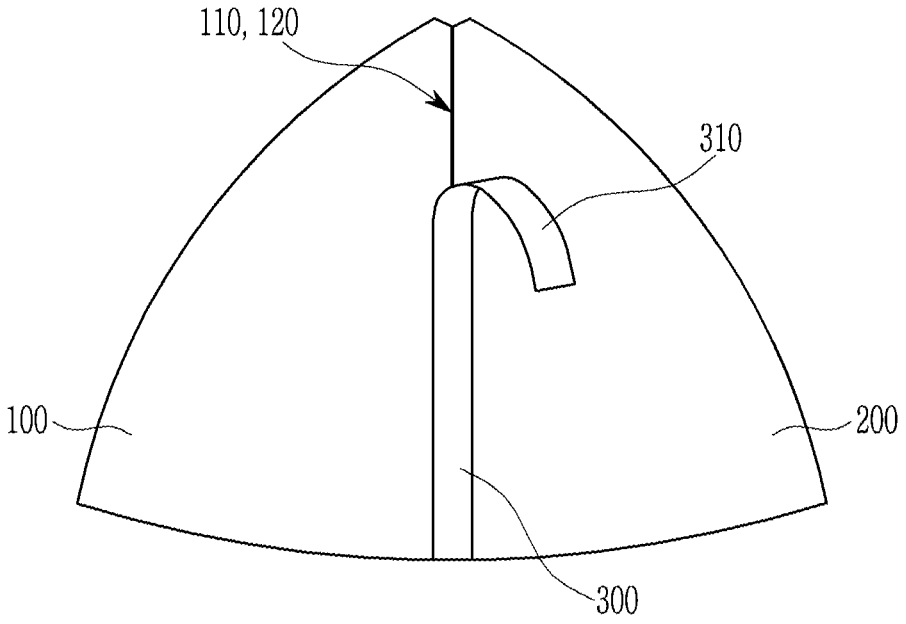
Figure 4D:
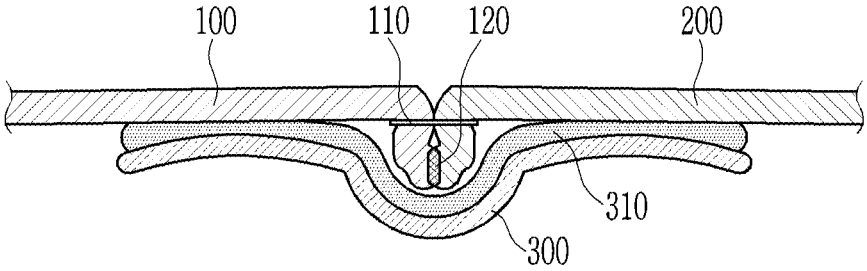

As shown in FIG. 4C and FIG. 4D, the connected panels 100 and 200 are unfolded, and a seam sealing tape 300 is attached to cover the portions processed by the ultrasonic wave processing 120 and the sewing 110. In this case, one side of the seam sealing tape 300 is coated with adhesive 310, and the adhesive-backed seam sealing tape 300 may be attached to the portions processed by the ultrasonic wave processing 120 and the sewing 110. The seam sealing tape 300 may be attached while the adhesive 310 is being set after having been melted by heat bonding. In this case, the adhesive 310 may have a thickness of about 20 μm to about 200 μm.

The seam sealing tape 300 may have a thickness of about 0.2 mm to about 0.5 mm, and a width of about 10 mm to about 20 mm. In addition, the seam sealing tape 300 may be made of a mixed material of synthetic fiber and thermoplastic resin.

As shown in FIG. 4A to FIG. 4D, among the plurality of panels 100 and 200, adjacent two panels 100 and 200 are connected by the sewing 110 and the ultrasonic wave processing 120, and the seam sealing tape 300 covers the connected portions by the ultrasonic wave processing 120 and the sewing 110. Other panels are attached to the connected panels 100 and 200 in the same way, one after another, until the crown portion is formed. In the embodiment of the present invention, the number of panels 100 and 200 of the crown portion is illustrated as six as an example, but the number of panels 100 and 200 is not limited thereto, and may be more or less than six.

In addition, among the plurality of panels, only two panels adjacent to each other and positioned adjoining the brim portion 400 may be connected to each other by performing sewing and ultrasonic wave processing simultaneously.

As shown in FIG. 5 and FIG. 6, the sweat absorbing portion 500 may be formed along the inner circumference of the lower part of the crown portion, where the wearer's head circumference contacts, and serves to absorb sweat generated from the wearer's head. In addition, a top button 600 may be provided at the top of the crown portion, through the inside and outside of the crown portion, to keep the connected panels 100 and 200 in one piece.

In addition, since the connected portions 110 and 120 of the panels 100 and 200 by the sewing and the ultrasonic wave processing are covered by the seam sealing tape 300 from the inside of the crown portion, the crown portion may have a smooth surface without a sewing line being exposed to view.

In addition, the plurality of panels 100 and 200 according to the present invention may be made of either synthetic fiber or natural fiber or a combination thereof. In this case, the plurality of panels 100 and 200 may be made of polyester or nylon, and may be made of any one of cotton, rayon, and wool, or a combination thereof.

Meanwhile, measurement result of a seam thickness according to a method for manufacturing the cap is compared as shown in [Table 1] to [Table 3] below.

[Table 1] shows a case that a cap is manufactured using a fabric with a thickness of 0.55 mm, and the fabric is made of polyester-rayon blended yarn, having warp-weft density of 94×62/inch (the warp yarn is made of 94 yarns per inch and the weft yarn is made of 62 yarns per inch). In addition, [Table 2] shows a case that a cap is manufactured with a fabric having a thickness of 0.6 mm, and the fabric is made of polyester spun yarn, having warp-weft density of 104×72/inch. [Table 3] shows a case that a cap is manufactured using a fabric with a thickness of 0.4 mm, and the fabric is made of cotton-polyester blended yarn, having warp-weft density of 112×56/inch.

TABLE 1

| Classification | General sewing | Seamless sewing | The present invention |
|---|---|---|---|
| Seam thickness (mm) | 3.10 | 1.80 | 1.90 |

TABLE 2

| Classification | General sewing | Seamless sewing | The present invention |
|---|---|---|---|
| Seam thickness (mm) | 3.80 | 2.10 | 2.20 |

TABLE 3

| Classification | General sewing | Seamless sewing | The present invention |
|---|---|---|---|
| Seam thickness (mm) | 2.80 | 1.70 | 1.75 |

Figure 2A:
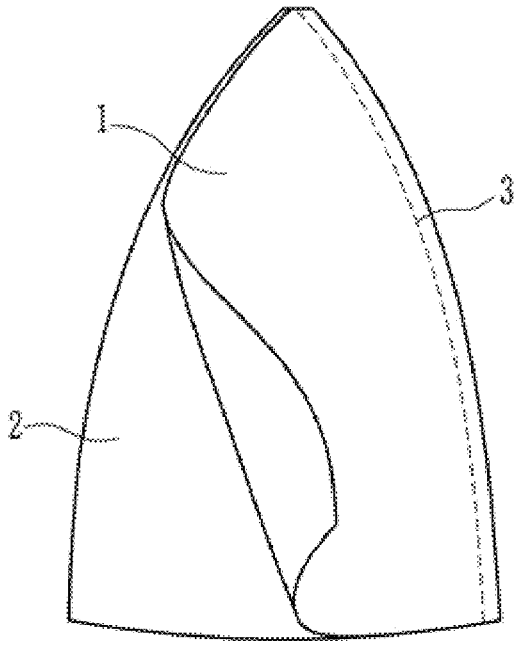
FIG. 2A to FIG. 2C show a process for manufacturing a crown of the cap, manufactured by an existing sewing method.
Figure 2B:
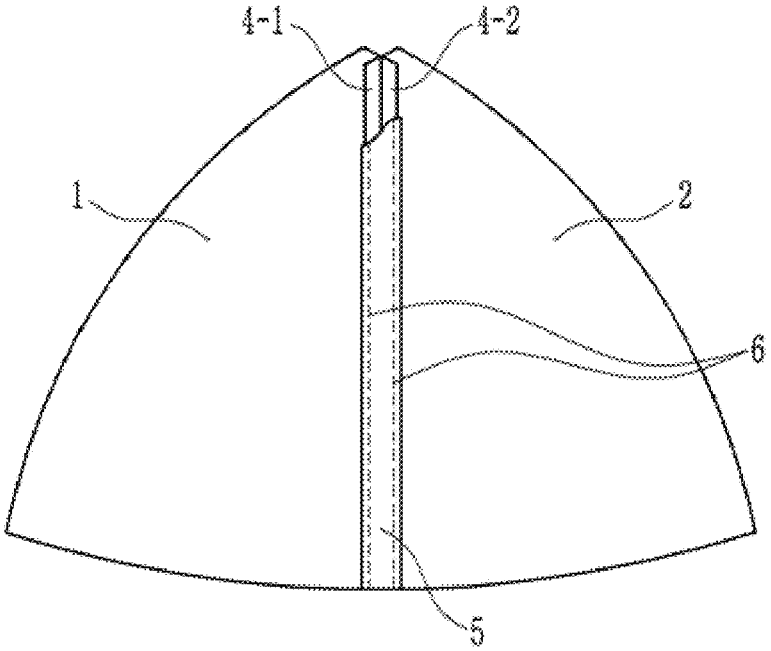
Figure 2C:
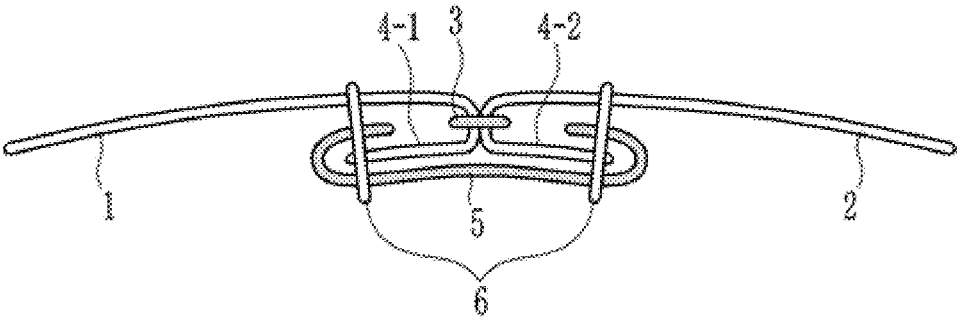

Referring to [Table 1] to [Table 3], it can be determined that a seam thickness according to the cap manufacturing method of the present invention is much less than a seam thickness according to the general sewing shown in FIG. 2A to FIG. 2C.

Figure 3A:
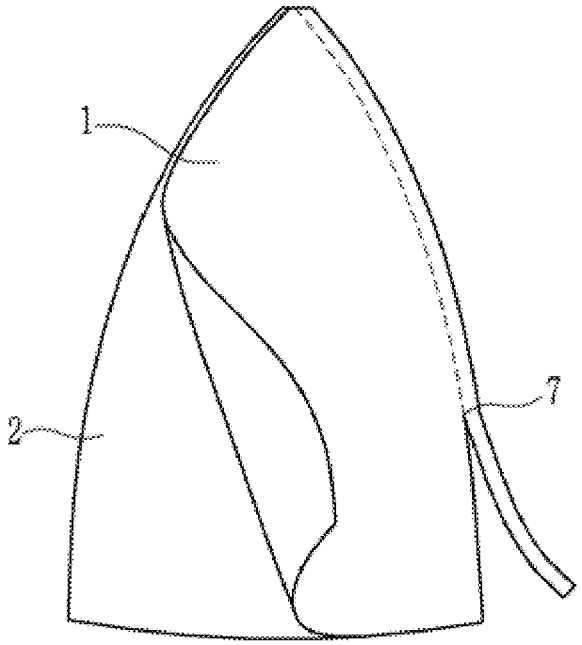
FIG. 3A to FIG. 3C show a process for manufacturing a crown of the cap, manufactured by an existing seamless sealing method.
Figure 3B:
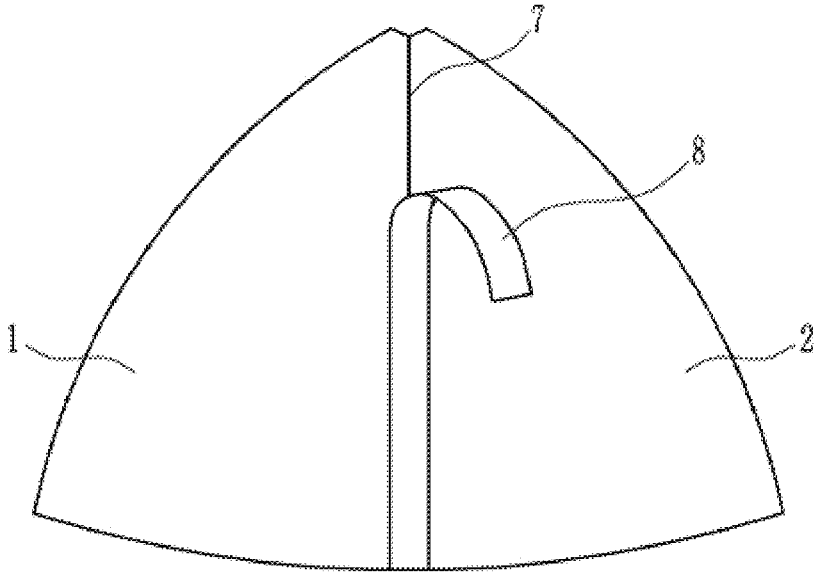
Figure 3C:
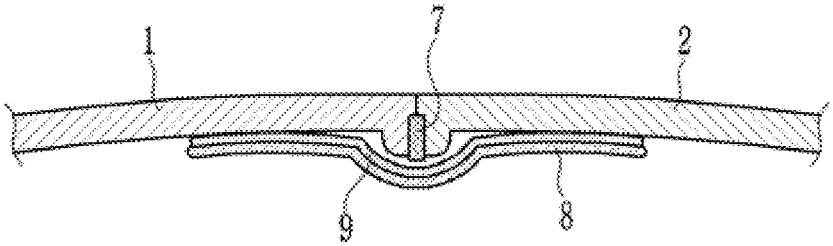

In addition, it can be determined that a seam thickness according to the cap manufacturing method of the present invention is slightly more than a seam thickness according to a seamless seam sealing method shown in FIG. 3A to 3C, but there is little difference in thickness, i.e. within 5%.

Figure 7:
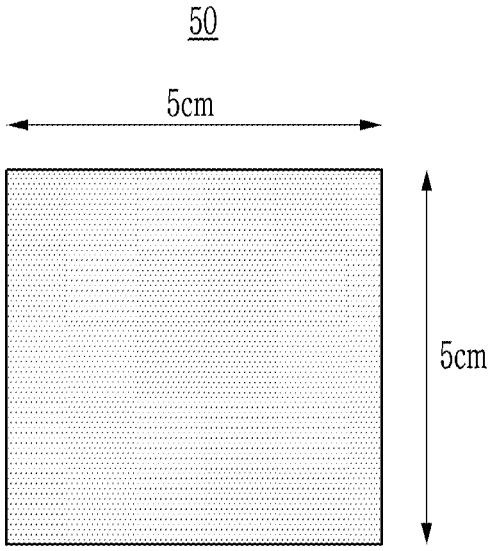
FIG. 7 shows a sample fragment used to compare a bursting strength of a sewing portion according to various methods for manufacturing a cap.
Figure 8:
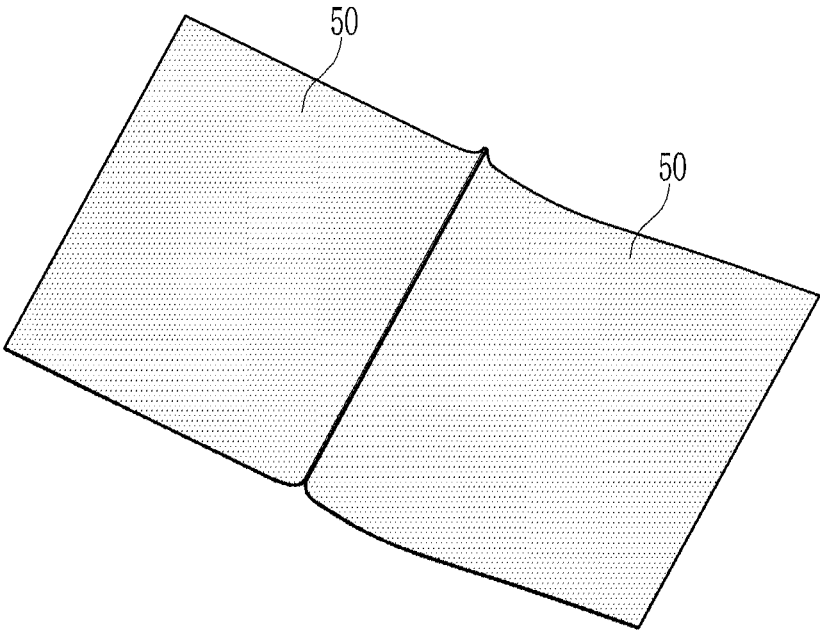
FIG. 8 shows a sample that is produced by connecting the sample fragments of FIG. 7 according to various manufacturing methods.

FIG. 7 shows a sample fragment used to compare a bursting strength of a sewing portion according to various methods for manufacturing a cap, and FIG. 8 shows a sample that is produced by connecting the sample fragments of FIG. 7 according to various manufacturing methods.

A sample fragment 50 shown in FIG. 7 is cut to 5 cm×5 cm size, and two sample fragments 50 are connected by general sewing, seamless sealing (ultrasonic wave melting), and a bonding method according to the present invention, respectively, as shown in FIG. 8.

[Table 4] shows the comparison of the bursting strength of the sewing portion according to the cap manufacturing method.

In this case, in [Table 4], sample A is 100% polyester yarn with PE20'S×PE20'S, density of 190×54/inch, and a thickness of 0.42 mm;

sample B is 60% cotton and 40% polyester with C/P20'S×20'S, density of 112×56/inch, and a thickness of 0.40 mm; and sample C is 100% cotton with C16'S×12'S, density of 114×58/inch, and a thickness of 0.49 mm.

In this case, 20'S denotes a thickness equal to the length of 20 m at the weight of 1 g; 16'S denotes a thickness equal to the length of 16 m at the weight of 1 g; and 12'S denotes a thickness equal to the length of 12 m at the weight of 1 g. In addition, C/P denotes cotton/polyester spun yarn, i.e. a twisted yarn by blending cotton and polyester single yarns at a certain ratio.

TABLE 4

| Classification | General sewing | Seamless sewing | The present invention |
|---|---|---|---|
| Sample A | 196 | 51 | 460 |
| Sample B | 124 | 41 | 370 |
| Sample C | 110 | — | 115 |

Referring to [Table 4], a rupture strength at which a connected portion is broken is measured by pulling each end of the sample made of two sample fragments 50 being connected according to general sewing, seamless sewing, and the method according to the present invention, and the measurement unit is Newton (N).

As shown in [Table 4], it can be determined that a bonding strength of the method according to the present invention is about 2.5 to about 9 times stronger than that of the existing general sewing and seamless sewing method. On the other hand, in the case of sample C formed only of natural fibers (cotton), it was not bonded by seamless sewing alone.

Figure 9:
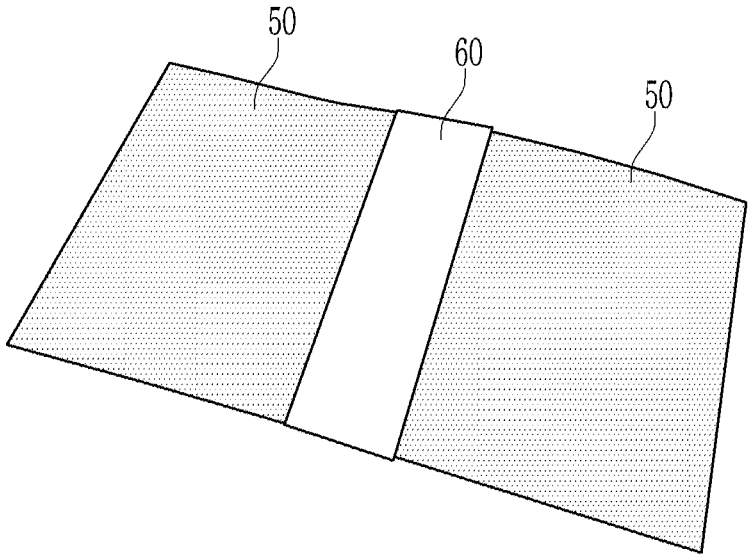
FIG. 9 shows a state in which a seam sealing tape is attached to the connected portion of the sample of FIG. 8.

Meanwhile, after attaching the seam sealing tape 60 to each connected portion of Samples A to C as described with reference to FIG. 9 and [Table 4], the rupture strength is compared as shown in [Table 5] below.

In this case, the seam sealing tape 60, with a width of 16 mm and a thickness of 0.32 mm, is formed of polyester 75D fabric, (knitted fabric made of a 9000 meter strand weighing 75 g), a polyurethane film, and a thermoplastic polyurethane (TPU) adhesive layer.

TABLE 5

| Classification | General sewing | Seamless sewing | The present invention |
|---|---|---|---|
| Sample A | 350 | 96 | 658 |
| Sample B | 239 | 85 | 586 |
| Sample C | 235 | 71 | 246 |

As shown in [Table 5], it can be determined that the method according to the present invention is approximately 2 times stronger than the existing general sewing, and approximately 6 to 7 times stronger than the seamless sewing.

Meanwhile, a productivity comparison of embroidery decoration according to the cap manufacturing method is shown in [Table 6] below.

In this case, in [Table 6], a cap is manufactured with a fabric made of a polyester-rayon blended, 30'S double yarn which has a warp-weft density of 94×62/inch and a thickness of 0.5 mm, and embroidery is applied on the connected portion of the panels to compare productivity. In this case, the 30'S double yarn is a yarn made by twisting two layers of yarn with a thickness of a strand weighing 1 g.

TABLE 6

| Classification | General sewing | Seamless sewing | The present invention |
|---|---|---|---|
| Embroidery thread breakage (1 pc, number of times) | 12 | 3 | 0 |
| Time taken for producing 1 pc (minute, second) | 24"41 | 21"42 | 19"10 |
| Daily production (8 Hr, 20 HEAD) | 393 pcs | 440 pcs | 448 pcs |

As shown in [Table 6], in the case of the method according to the present invention, it can be determined that the number of embroidery thread breakage is 0 until one embroidery design is complete. It can be determined that the present invention, compared to general sewing and seamless sewing, reduces embroidery thread breakage significantly. In addition, in the case of the method according to the present invention, it takes 19 minutes and 10 seconds to produce one embroidery decoration, and its daily production volume is about 448 pieces. It can be determined that the present invention, compared to the general sewing and the seamless sewing, improves the productivity by about 13%.

Figure 10:
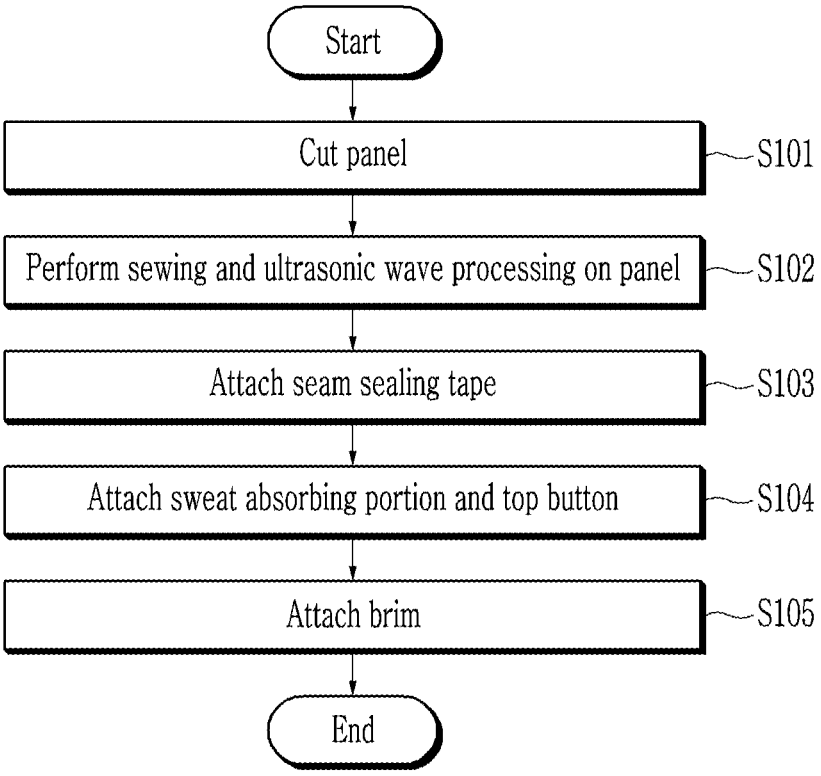
FIG. 10 shows a cap manufacturing method according to an embodiment of the present invention.

FIG. 10 shows a method for manufacturing a cap according to an embodiment of the present invention.

Referring to FIG. 10, according to a cap manufacturing method according to an embodiment of the present invention, a plurality of panels are cut into a certain shape for the crown shape of the cap (S101).

After that, two panels are disposed to be overlapped, and in order to join the two panels together, sewing with a thread and a needle and ultrasonic wave processing are simultaneously performed along a lateral side of the panels, lengthways (S102).

After that, the connected two panels are unfolded, and a seam sealing tape is attached to cover a portion where the ultrasonic wave processing is performed and a portion where the sewing is performed (S103). The seam sealing tape is attached by an adhesive and thermal bonding can be performed. As described, all the plurality of panels are connected to complete the crown, a sweat absorbing portion is connected to an inner circumference of a lower portion of the crown portion, and a top button is attached to the top of the crown portion (S104).

After that, the cap production step is completed by attaching a brim to the lower portion of the crown portion (S105).

Furthermore, adding a logo or embroidery over the panel, or forming a size adjustment portion may be included. The size adjusting portion may be formed by forming a half opening at a lower end of a rear panel of the crown portion and attaching a size adjusting member to the half opening.

As such, according to the embodiments of the present invention, in connecting the panels to form the crown of the cap, both sewing and ultrasonic wave processing are performed simultaneously, and the seam portion of the connected panels is thin, with smooth surface, and thereby having improved wearing comfort.

In addition, when adding a embroidery design to caps, it can improve both productivity and quality by reducing incidence of the needle breakage of the embroidery machine or the breakage of the embroidery thread.

In addition, compared to the existing seamless sealing method, the present invention can improve durability since sewing and ultrasonic wave processing are performed simultaneously.

Furthermore, the method can be employed for natural fabrics as well as man-made fibers, and thus consumers can get a wide range of choice in style.

While this invention has been described in connection with what is presently considered to be practical embodiments, it is to be understood that the invention is not limited to the disclosed embodiments. On the contrary, it is intended to cover various modifications and equivalent arrangements included within the spirit and scope of the appended claims.

DESCRIPTION OF SYMBOLS

50: sample fragment
60: tape
100, 200: panel
110: sewing (portion)
120: ultrasonic wave processing (portion)
300: seam sealing tape
310: adhesive
400: brim (portion)
500: sweat absorbing portion
600: top button

What is claimed is:

1. A cap comprising:

a crown portion, the crown portion having a plurality of panels connected together;

a brim portion attached to a lower end of the crown portion; and a sweat absorbing portion attached to an inner lower end of the crown portion, wherein at least two adjacent panels among the plurality of panels are overlapped and joined simultaneously by both a stitching and an ultrasonic bond, wherein overlapping edge portions of the at least two adjacent panels are trimmed and fused by ultrasonic bonding to form the ultrasonic bond, wherein the stitching is disposed at a position inward of and entirely spaced apart from the ultrasonic bond and does not overlap with the ultrasonic bond, wherein a seam sealing tape is attached to cover both the ultrasonic bond and the stitching, and wherein the plurality of panels are formed of synthetic fiber, natural fiber, or a combination of the synthetic fiber and the natural fiber.

2. The cap of claim 1, wherein:

the stitching is spaced apart from the ultrasonic bond by a distance of 0.5 mm to 1.5 mm.

3. The cap of claim 1, wherein:

an adhesive is coated to one side of the seam sealing tape, and the seam sealing tape is attached to the ultrasonic bond and the stitching by the adhesive.

4. The cap of claim 3, wherein:

the seam sealing tape is attached to the ultrasonic bond and the stitching by thermal adhesion.

5. The cap of claim 3, wherein:

the adhesive has a thickness of 20 μm to 200 μm.

6. The cap of claim 1, wherein:

the seam sealing tape has a thickness of 0.2 mm to 0.5 mm.

7. The cap of claim 1, wherein:

the seam sealing tape has a width of 10 mm to 20 mm.

8. The cap of claim 1, wherein:

the seam sealing tape is formed of a mixed material of synthetic fiber and thermoplastic resin.

9. The cap of claim 1, wherein:

the plurality of panels are formed from the synthetic fiber, and the synthetic fiber comprises polyester or nylon.

10. The cap of claim 1, wherein:

the plurality of panels are formed from the combination of the synthetic fiber and the natural fiber, the synthetic fiber comprises polyester or nylon, and the natural fiber comprises one of cotton, rayon, wool, or a combination of cotton, rayon, and wool.

* * * * *